US010264877B2

(12) United States Patent
Hu et al.

(10) Patent No.: US 10,264,877 B2
(45) Date of Patent: Apr. 23, 2019

(54) HEIGHT ADJUSTMENT MECHANISM, PLATFORM AND METHOD

(71) Applicant: DESIGNA INC., Foshan (CN)

(72) Inventors: Yajun Hu, Foshan (CN); Chuyao Zhou, Hunan (CN)

(73) Assignee: DESIGNA INC., Foshan (CN)

( * ) Notice: Subject to any disclaimer, the term of this patent is extended or adjusted under 35 U.S.C. 154(b) by 0 days.

(21) Appl. No.: 15/224,845

(22) Filed: Aug. 1, 2016

(65) Prior Publication Data

US 2017/0290413 A1 Oct. 12, 2017

(30) Foreign Application Priority Data

Jun. 3, 2016 (CN) ..... 2016 1 0388959

(51) Int. Cl.

*A47B 9/00* (2006.01)
*A47B 9/16* (2006.01)
*A47B 21/02* (2006.01)

(52) U.S. Cl.

CPC ..... *A47B 9/16* (2013.01); *A47B 21/02* (2013.01)

(58) Field of Classification Search

CPC ..... A47B 9/04; A47B 2200/0041; A47B 9/16; A47B 9/18

USPC ..... 108/147

See application file for complete search history.

(56) References Cited

U.S. PATENT DOCUMENTS 4,073,240 A 2/1978 Fly
4,519,649 A * 5/1985 Tanaka ..... A61G 5/14 297/316
4,558,553 A 12/1985 Kolk
(Continued)

FOREIGN PATENT DOCUMENTS

CN 202168584 3/2012
CN 102536126 7/2012
(Continued)

OTHER PUBLICATIONS

"Varidesk—Height-Adjustable Standing Desk"; [online] [retrieved Jan. 11, 2017]. Retrieved from the Internet: <URL: https://www.amazon.com/VARIDESK-Height-Adjustable-Standing-Cubicles-Corner/dp/B017BUXRRE/ref=sr_1_1?ie=UTF8&qid=1483986540&sr=8-1-spons&keywords=VARIDESK-Height-Adjustable-Standing-Desk&psc=1>, (dated 2017) 8 pages.
(Continued)

*Primary Examiner* — Matthew W Ing
(74) *Attorney, Agent, or Firm* — Alston & Bird LLP

(57) ABSTRACT

A height adjustment mechanism is provided. The height adjustment mechanism includes a lifting arm, a driving mechanism configured to drive and lock the lifting arm, and a control switch configured to control the driving mechanism; the driving mechanism is coupled to the lifting arm, and an angle is formed between the driving mechanism and the lifting arm. A height adjustment platform and method is also provided. The height adjustment platform includes a first working table, a bottom bracket, a lifting arm, a driving mechanism configured to drive and lock the lifting arm, and a control switch configured to control the driving mechanism; two opposite ends of the lifting arms are separately coupled to the first working table and the bottom bracket, the driving mechanism is coupled to the lifting arm, and the
(Continued)

angle is formed between the driving mechanism and the lifting arm.

13 Claims, 6 Drawing Sheets

(56) References Cited

U.S. PATENT DOCUMENTS

| | | | | |
|---|---|---|---|---|
| 5,649,493 | A * | 7/1997 | Blume | A47B 9/00 108/136 |
| D395,969 | S | 7/1998 | Barlow-Lawson | |
| 5,823,120 | A | 10/1998 | Holmquist | |
| D424,828 | S | 5/2000 | Ko | |
| D428,279 | S | 7/2000 | Olson | |
| 6,116,557 | A | 9/2000 | Choy | |
| 6,148,739 | A | 11/2000 | Martin | |
| D435,368 | S | 12/2000 | Tzeng | |
| D436,268 | S | 1/2001 | Ko | |
| D447,646 | S | 9/2001 | Chang | |
| D464,212 | S | 10/2002 | Chen | |
| D486,669 | S | 2/2004 | Wang | |
| D499,576 | S | 12/2004 | Long | |
| D530,939 | S | 10/2006 | Nakamura | |
| D583,587 | S | 12/2008 | Lai | |
| D586,155 | S | 2/2009 | Lenterman | |
| D612,643 | S | 3/2010 | Rossini et al. | |
| 8,065,966 | B1 | 11/2011 | Bacon et al. | |
| D652,229 | S | 1/2012 | Madison | |
| D681,979 | S | 5/2013 | Keen et al. | |
| D691,223 | S | 10/2013 | Hao | |
| 8,671,853 | B2 | 3/2014 | Flaherty | |
| 8,800,454 | B2 * | 8/2014 | Jones | A47B 9/02 108/10 |
| D716,074 | S | 10/2014 | Kitajima | |
| 9,049,923 | B1 | 6/2015 | Delagey et al. | |
| 9,055,810 | B2 | 6/2015 | Flaherty | |
| D733,476 | S | 7/2015 | Papic et al. | |
| 9,113,703 | B2 | 8/2015 | Flaherty | |
| 9,277,809 | B2 | 3/2016 | Flaherty et al. | |
| 9,289,058 | B2 | 3/2016 | Flaherty | |
| 9,326,598 | B1 | 5/2016 | West et al. | |
| D771,981 | S | 11/2016 | Flaherty et al. | |
| D771,982 | S | 11/2016 | Flaherty et al. | |
| 9,504,316 | B1 | 11/2016 | Streicher et al. | |
| 9,554,644 | B2 | 1/2017 | Flaherty et al. | |
| D781,617 | S | 3/2017 | Flaherty et al. | |
| D781,618 | S | 3/2017 | Flaherty et al. | |
| D781,619 | S | 3/2017 | Flaherty et al. | |
| D784,050 | S | 4/2017 | Flaherty et al. | |
| D785,386 | S | 5/2017 | Flaherty et al. | |
| D785,989 | S | 5/2017 | Flaherty et al. | |
| D814,214 | S | 4/2018 | Flaherty et al. | |
| 2003/0116066 | A1 | 6/2003 | Ken | |
| 2003/0140822 | A1 | 7/2003 | Seiler et al. | |
| 2003/0230222 | A1 | 12/2003 | Liu | |
| 2005/0045072 | A1 | 3/2005 | Rossini | |
| 2005/0284341 | A1 | 12/2005 | Klassy et al. | |
| 2008/0072803 | A1 | 3/2008 | Korber et al. | |
| 2012/0193495 | A1 | 8/2012 | Sugiyama et al. | |
| 2013/0139736 | A1 | 6/2013 | Flaherty | |
| 2013/0340655 | A1 | 12/2013 | Flaherty | |
| 2014/0020606 | A1 | 1/2014 | Benden | |
| 2014/0048671 | A1 | 2/2014 | Tsai | |
| 2014/0123883 | A1 | 5/2014 | Jennings et al. | |
| 2014/0158026 | A1 | 6/2014 | Flaherty | |
| 2015/0250303 | A1 * | 9/2015 | Flaherty | A47B 9/18 108/50.02 |
| 2015/0289641 | A1 * | 10/2015 | Ergun | A47B 9/16 108/42 |
| 2015/0296976 | A1 | 10/2015 | Janowski et al. | |
| 2016/0073779 | A1 | 3/2016 | Ringlein | |
| 2016/0109056 | A1 * | 4/2016 | Chen | B25H 1/12 248/277.1 |
| 2016/0150876 | A1 | 6/2016 | Flaherty et al. | |
| 2017/0354245 | A1 | 12/2017 | Martin et al. | |
| 2017/0360192 | A1 | 12/2017 | Hu | |
| 2018/0055214 | A1 | 3/2018 | Kim et al. | |
| 2018/0103752 | A1 | 4/2018 | Zhong | |
| 2018/0140089 | A1 | 5/2018 | Black burn | |

FOREIGN PATENT DOCUMENTS

| | | |
|---|---|---|
| CN | 203873238 | 10/2014 |
| CN | 204541230 | 8/2015 |
| CN | 105901923 | 8/2016 |
| DE | 29614295 | 9/1996 |
| SE | 504292 | 12/1996 |

OTHER PUBLICATIONS

"Halter ED-258 Preassembled Height Adjustable Desk Sit / Stand Desk Elevating Desktop", [online] [retrieved Jan. 11, 2017]. Retrieved from the Internet: <URL: https://www.amazon.com/Halter-ED-258-Preassembled-Adjustable-Elevating/dp/B01BMULFAA/ref=sr_1_fkmr0_1?ie=UTF8&qid=1483986452&sr=8-1-fkmr0&keywords=Halter+ED-258+Pre+Desk+Elevating+Desk>, (dated 2017) 9 pages.

"Rocelco ADR Height Adjustable Sit/Stand Desk Computer Riser"; [online] [retrieved Jan. 11, 2017]. Retrieved from the Internet: <URL: https://www.amazon.com/Rocelco-ADR-Adjustable-Computer-Capacity/dp/B015GCGOD8/ref=sr_1_1?ie=UTF8&qid=1483986493&sr=8-1&keywords=rocelco+adr>, (dated 2017) 8 pages.

"FlexiSpot 35" Wide Platform Height Adjustable Standing Desk Riser"; [online] [retrieved Jan. 11, 2017]. Retrieved from the Internet: <URL: https://www.amazon.com/FlexiSpot-Platform-Adjustable-Removable-M2B-M-SIZE/dp/B01HPE05BM/ref=sr_1_1?ie=UTF8&UTF8&qid=1483986590&sr=8-1&keywords=flexispot+35+riser>, (dated 2017) 9 pages.

"Ergotron Work Fit-T Sit-Stand Desktop Workstation Stand with Table Mount"; [online] [retrieved Jan. 11, 2017]. Retrieved from the Internet: <URL: https://www.amazon.com/Ergotron-Sit-Stand-Desktop-Workstation-33-397-085/dp/B00QL6IGWQ/ref=sr_1_1?ie=UTF8&qid=1483986627&sr=8-1&keywords=ergotron+work+table>, (dated 2017) 8 pages.

Office Action for U.S. Appl. No. 15/689,548, dated May 29, 2018, 11 pages.

International Search Report and Written Opinion for Application No. PCT/CN2016/108694 dated Jun. 3, 2016, 10 pages.

Fancierstudio, posted at Amazon.com, posted on Dec. 20, 2016, site visited Jun. 20, 2018. online, available from internet: https://www.annazon.conn/dp/B01NCKI U70.

iMovR, posted at Amazon.com, posted on Jan. 30, 2017, site visited Jun. 20, 2018. online, available from internet: https://www.amazon.com/ iMovR-Standing-Converter-Ergonomic-Keyboard/dp/B074XMZ7MN.

Office Action for U.S. Appl. No. 29/598,176 dated Jun. 27, 2018, 8 pages.

Stand Steady, posted at Amazon.com, posted on Jan. 3, 2017, site visited Jun. 20, 2018. online, available from internet: https://www.annazon.conn/Stand-Steady-Award-Winning-Spring-Assisted-Adjustable/dp/B01N98WU1E.

* cited by examiner

HEIGHT ADJUSTMENT MECHANISM, PLATFORM AND METHOD

FIELD

The subject matter herein generally relates to a height adjustment mechanism, platform and method, and particularly to a height adjustment mechanism, platform and method used in office.

BACKGROUND

In recent years, with the development and popularization of computer technology, more and more people can work or study by computer. In order to maintain a good posture to prevent occupational injuries, height adjustment platforms can be sold on the market to meet the need of adjusting the height of office supplies.

The existing height adjustment platform may be a desk in which the height can be adjusted according to the need of the user. The height adjustment platform can include a height adjustment mechanism which is manually driven by the hands of the user. That is, the user lifts or moves down the existing height adjustment platform completely according to their hands. However, manual operation may be not convenient for the user to operate the height adjustment platform.

In general, the height adjustment platform can include a bottom part, a top part, a lifting mechanism, and a locking mechanism. The lifting mechanism and the locking mechanism can be connected between the bottom part and the top part. The locking mechanism can include a number of position holes or position grooves defined on the bottom of the top part, and a position bolt mounted on the lifting mechanism. In order to adjust the height of the top part, the user would need to pull out the position bolt from the position hole or position groove, and adjust the distance between the top part and the bottom part, and then insert the position bolt into the position hole or position groove to position the top part. However, the structure of the height adjustment platform may be complex, and the lifting height may be limited by the location of each position hole.

In addition, the height adjustment mechanism of the existing height adjustment platform can be generally manually driven by the hands of the user. The user lifts or moves down the existing height adjustment platform completely according to their hands. A connecting structure and a locking structure can be positioned on the bottom of the top part of existing height adjustment platform to increase the weight of the top part. Thus, it costs time and energy to lift or move down the top part, and it is not convenient for the user to lift or move down the top part.

However, because the lifting mechanism can be directly hinged to the bottom part and the top part, the lifting mechanism must rotate 0~90 degrees to lift the top part. In this way, the top part must horizontally move a long distance during lifting the top part. As such, a large operating space is needed to lift the height adjustment platform.

The user manually lifts or moves down the top part to rotate the lifting arm to lift or move down the existing height adjustment platform. However, the height adjustment method of the existing height adjustment platform is not convenient to operate, and costs time and energy.

SUMMARY OF THE INVENTION

An objective of the present invention is to provide a height adjustment mechanism having a simple structure, being applied on any one product which is needed to be adjusted the height thereof, and being convenient to use. The present invention further provides a height adjustment platform including the height adjustment mechanism. The height adjustment is convenient to use and decreases the operation space to improve the universality. The present invention further provides a height adjustment method.

The above objectives of the present invention can be achieved by the following technical scheme. A height adjustment mechanism includes a lifting arm, a driving mechanism configured to drive and lock the lifting arm, and a control switch configured to control the driving mechanism; the driving mechanism is coupled to the lifting arm, and an angle θ is formed between the driving mechanism and the lifting arm.

In the above technical scheme, the height adjustment mechanism controls the driving mechanism via the control switch to drive the lifting arm, so as to drive the working table to move up and down. Because the angle θ is formed between the driving mechanism and the lifting arm, which ensures the driving mechanism can apply force to the lifting arm to let the operation of the height adjustment mechanism become convenient.

More specifically, the lifting arm comprises two parallel rods, a first joint device, and a second joint device; two ends of each rod is respectively coupled to the first joint device and the second joint device; the two rods, the first joint device, and the second joint device are coupled end to end to cooperatively form a parallelogram structure; when in use, the first joint device is coupled to a lifting surface, the second joint device is coupled to a support surface.

The lifting arm comprises two parallel rods, a first joint device, and a second joint device; two ends of each rod is respectively coupled to the first joint device and the second joint device; the two rods, the first joint device, and the second joint device are coupled end to end cooperatively forming a parallelogram structure; when in use, the first joint device is vertical to the lifting surface, the second joint device is vertical to the support surface.

Both of the first joint device and the second joint device are not used as connecting members, but used as limiting members. Because the first joint device is vertical to the lifting surface and the second joint device is vertical to the support surface, which can limit the rotation angle of the lifting arm to let the working table substantially move vertically, so as to decrease the operation space.

There are three ways to form the angle θ between the driving mechanism and the lifting arm which is coupled to the driving mechanism. One way, the driving mechanism is positioned in the parallelogram structure, and the angle θ is formed between the driving mechanism and the rod of the lifting arm.

The second way, the driving mechanism comprises a support rod extending into the parallelogram structure to connect the rod of the lifting arm, and the angle θ is formed between the support rod and the rod of the lifting arm.

The third way, the driving mechanism is positioned outside of the parallelogram structure and coupled to the rod of the lifting arm, and the angle θ is formed between the driving mechanism and the rod of the lifting arm.

The driving mechanism is positioned into the parallelogram structure to prevent the working table from inclining, and to decrease the weight of the working table. Thus the user can use less force to lift or move down the working table, and the driving force of the driving mechanism can be decreased to save costs.

A power device is integrated with the locking device to form the driving mechanism, or the driving mechanism comprises the power device and the locking device positioned apart from the power device.

The driving mechanism is a self-locking gas spring, the self-locking gas spring comprises a base body, a releasing rod, and a releasing head coupled to the base body via the releasing rod. The self-locking gas spring can be one industrial component which has functions of supporting, buffering, braking, height adjustment, and angle adjustment. The self-locking gas spring can stop at any position during its moving, and have a large locking force after it stops. Thus, the height adjustment mechanism can move the working table to a predetermined position which is located between the lowest point and the highest point of the working table to increase the utility of the height adjustment platform.

The driving mechanism can include other types of power device and locking device which are integrated with each other or positioned apart from each other, for example, a gas spring is used as the power device, and a mechanical locking device is used as the locking device.

The control switch comprises a control wire, a fasten member, and a handle mounted on the fasten member; a first end of the control wire is coupled to the handle, a second end of the control wire is coupled to the releasing head of the self-locking gas spring.

A height adjustment platform includes a first working table, a bottom bracket, at least one lifting arm, at least one driving mechanism configured to drive and lock the lifting arm, and at least one control switch configured to control the driving mechanism; two opposite ends of the lifting arms are separately coupled to the first working table and the bottom bracket, the driving mechanism is coupled to the lifting arm, and the angle θ is formed between the driving mechanism and the lifting arm.

In the above technical scheme, the height adjustment mechanism controls the driving mechanism via the control switch to drive the lifting arm, so as to drive the working table to move up and down. Because the angle θ is formed between the driving mechanism and the lifting arm, which ensures the driving mechanism can apply force to the lifting arm to let the operation of the height adjustment mechanism become convenient.

The lifting arm is rotatably coupled to the first working table and the bottom bracket; when in use, both of the lifting arm and the bottom bracket rotate an angle α ranging from 0 to 60 degrees. The lifting arm of the present invention is coupled to the bottom bracket via the first joint device and the second joint device. Because the first joint device is vertical to the lifting surface and the second joint device is vertical to the support surface, which can limit the rotation angle of the lifting arm, the rotation angle α between the lifting arm and the first working table or between the lifting arm and the bottom bracket ranges from 0 to 60 degrees. Because of the arrangement of the first joint device and the second joint device, the rotation angle of the lifting arm during lifting or moving down the first working table is small, and the first working table substantially moves vertically. Thus, the driving mechanism drives the lifting arm to move during the driven travel of the driving mechanism to let the lift during the height adjustment platform to be lifted to an ideal height thereof, and the first working table will not horizontally move a long distance during the process of rising and falling. So that, the operation space of the height adjustment platform can be decreased to improve the universality.

The height adjustment platform further includes two lifting arms and at least one connecting rod. The two lifting arms are positioned on opposite sides between the first working table and the bottom bracket, the connecting rod is positioned between the two lifting arms, and two opposite ends of the connecting rod are coupled to the two lifting arms.

The height adjustment platform further includes a second working table positioned below the first working table and at least one support arm. The second working table is coupled to the bottom of the first working table via the support arm.

An area of the second working table is more than a half of the area of the first working table.

A height adjustment method includes: applying a first working table, a bottom bracket, at least one lifting arm, at least one driving mechanism configured to drive and lock the lifting arm, and at least one control switch configured to control the driving mechanism, wherein two ends of the lifting arm are respectively coupled to the first working table and the bottom bracket, the angle θ is formed between the driving mechanism and the lifting arm; controlling the driving mechanism via the control switch to move the lifting arm which is coupled to the driving mechanism with the angle θ formed between the driving mechanism and the lifting arm, so as to move up or move down the first working table.

The process of controlling the driving mechanism via the control switch to move the lifting arm which is coupled to the driving mechanism with the angle θ formed between the driving mechanism and the lifting arm to move up or move down the first working table includes two steps.

Firstly, the driving mechanism is controlled to start, and the first working is lifted or pressed, such that the driving mechanism can jack up the lifting arm which is coupled to the driving mechanism with the angle θ formed between the driving mechanism and the lifting arm to lift the first working table, or the driving mechanism can shrink the lifting arm which is coupled to the driving mechanism with the angle θ formed between the driving mechanism and the lifting arm to move down the first working table.

Secondly, after the first working table moves to a predetermined position which is located between the lowest point and the highest point of the first working table, the driving mechanism is controlled to be closed, so as to lock the first working table to the predetermined position.

The height adjustment platform of the present invention is used according to the follow method.

Firstly, the user can hold the handle and open the handle, and then the releasing head of the self-locking gas spring can be opened under the control of the height adjustment platform, and then the user can subsidiarily lift or press the first working table lightly, the releasing rod can extend to jack up the lifting arm to raise the first working table, or the releasing rod can shrink to move down the lifting arm and the first working table.

Secondly, after the first working table moves to the predetermined position between the lowest point and the highest point of the first working table, the user can release the handle to reset the control switch and the releasing head, and then the first working table can be locked on the predetermined position by the self-locking gas spring.

With the above technical scheme, the present invention includes at least the following advantages and beneficial effects: firstly, the height adjustment mechanism can be applied on any product which is needed to adjust height, so as to solve the problem of laborious and operating inconvenience caused by the manual power for lifting; secondly, the height adjustment platform can have properties of simple structure, strong practicality, and convenient operation, so as to solve the problem of laborious and operating inconvenience caused by the manual power for lifting; thirdly, the operation space of the height adjustment platform of the present invention can be decreased, thus the height adjustment platform can have advantages of wide universality and extensive use-area; and forth, the height adjustment platform can be easily operated.

BRIEF DESCRIPTION OF THE DRAWINGS

Implementations of the present technology will now be described, by way of example only, with reference to the attached figures.

Figure 1:
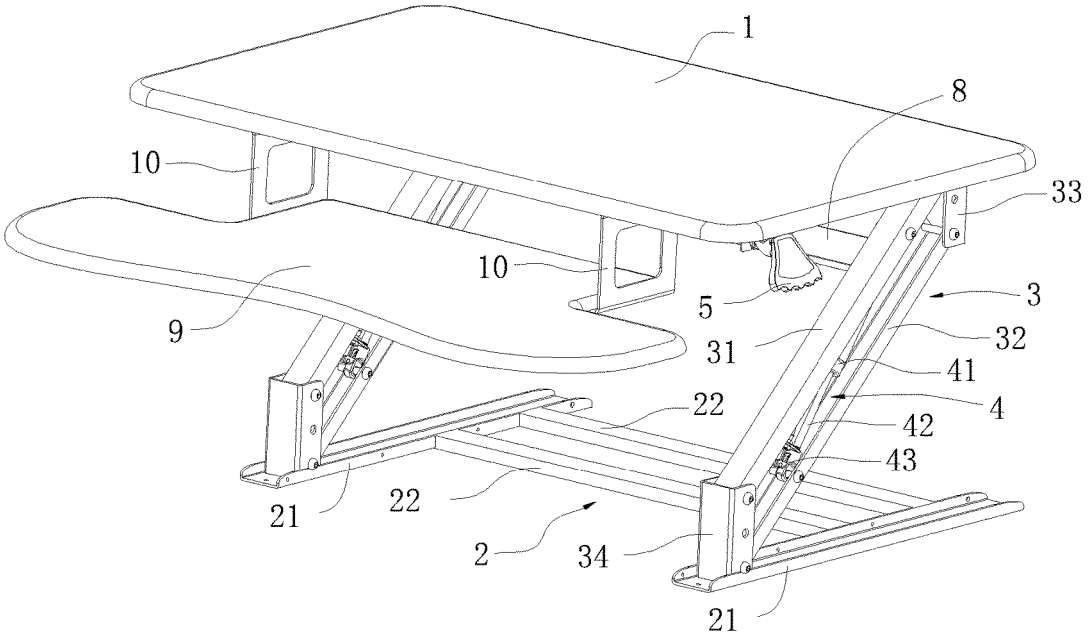
FIG. 1 is an isometric view of a first embodiment of a height adjustment platform.
Figure 2:
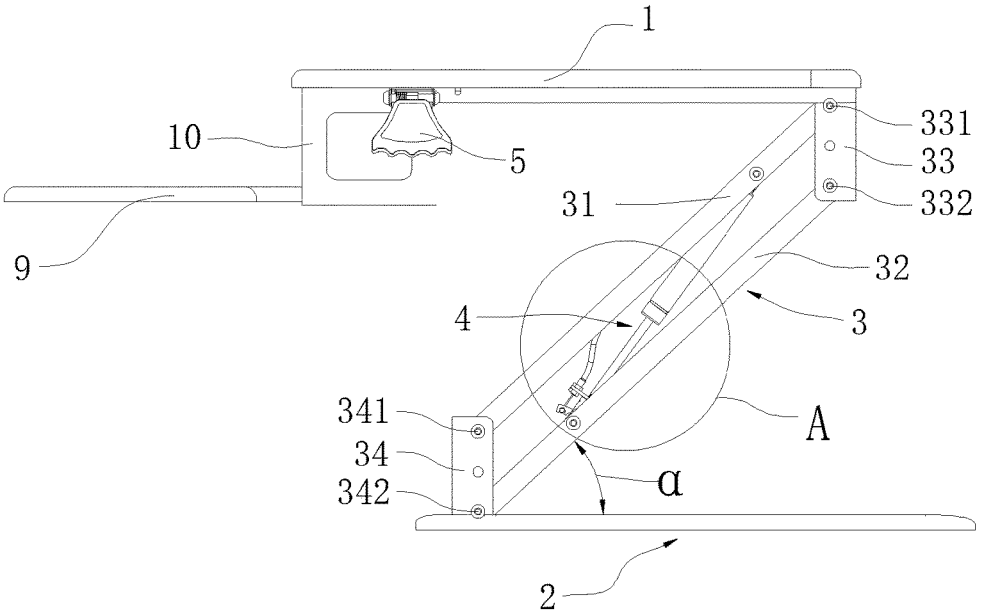
FIG. 2 is a right side elevational view of the height adjustment platform of FIG. 1.
Figure 3:
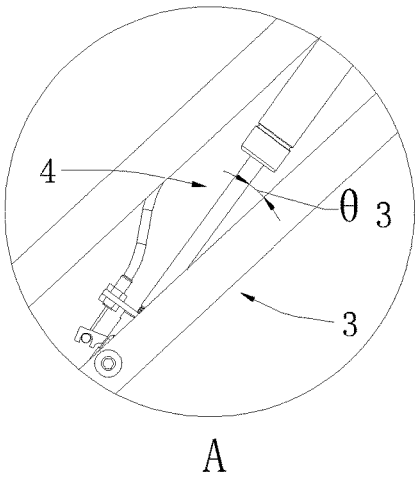
FIG. 3 is an enlarge view of the portion A of FIG. 2.
Figure 4:
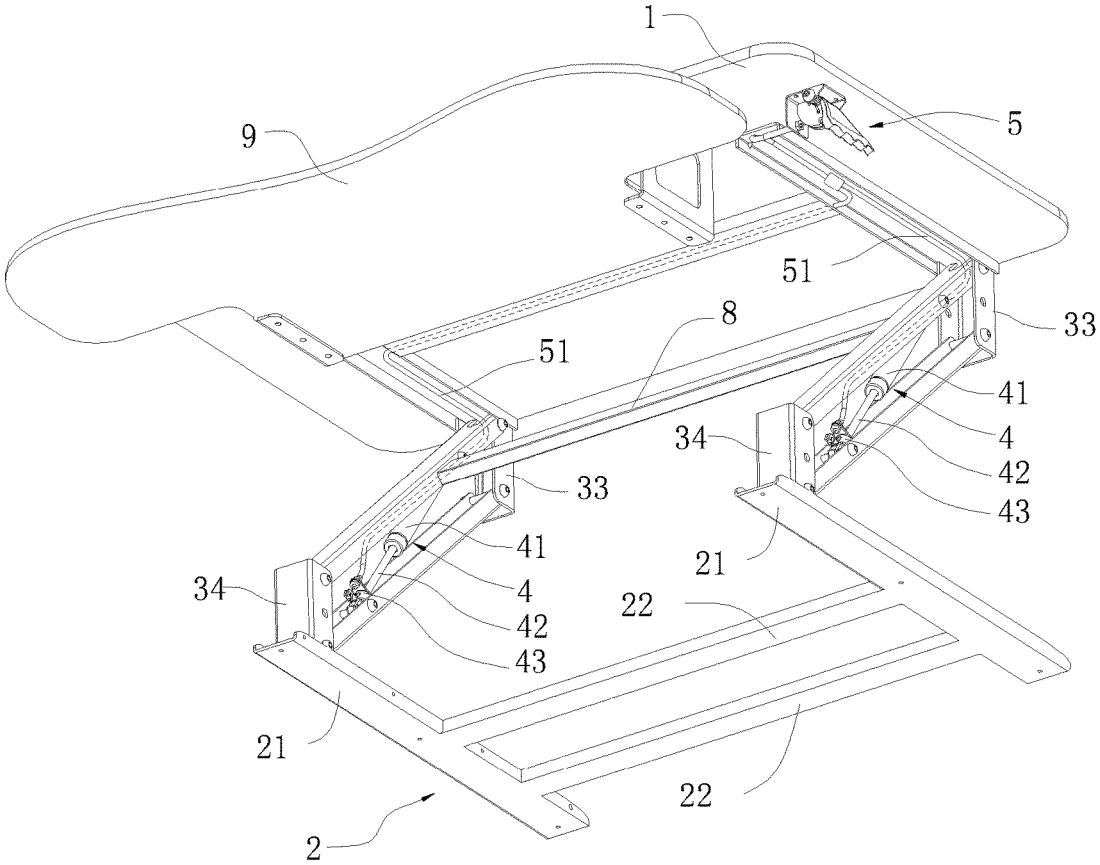
FIG. 4 is similar to FIG. 1, but viewed from another angle.
Figure 5:
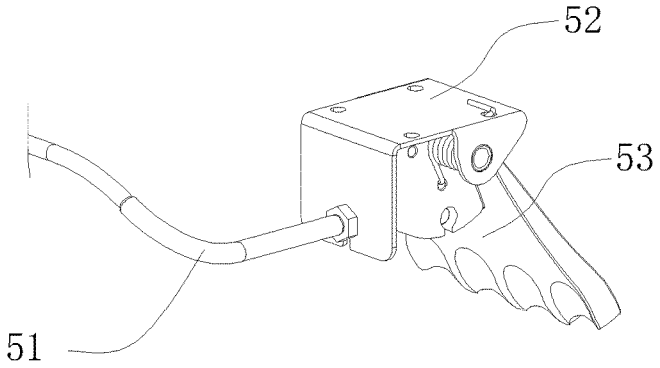
FIG. 5 is an isometric view of a control switch for controlling the height adjustment platform.

In the drawings, reference number 1 refers to the first working table, reference number 2 refers to the bottom bracket, reference number 21 refers to the pole, reference number 22 refers to the strengthening rib, reference number 3 refers to the lifting arm, reference number 31 refers to the first rod, reference number 32 refers to the second rod, reference number 33 refers to the first joint device, reference number 331 refers to the first hinge point between the first rod and the first joint device, reference number 332 refers to the third hinge point between the second rod and the first joint device, reference number 34 refers to the second joint device, reference number 341 refers to the second hinge point between the first rod and the second joint device, reference number 342 refers to the forth hinge point between the second rod and the hinge device, reference number 4 refers to the self-locking gas spring, reference number 41 refers to the base body, reference number 42 refers to the releasing rod, reference number 43 refers to the releasing head, reference number 5 refers to the control switch, reference number 51 refers to the control wire, reference number 52 refers to the fasten member, reference number 53 refers to the handle, reference number 8 refers to the connecting rod, reference number 9 refers to the second working table, reference number 10 refers to the support arm, reference number 11 refers to the support rod, reference number 12 refers to the power device, reference number 13 refers to the locking device, reference number 131 refers to the telescopic pole 131, reference number 132 refers to the button switch, and reference number 14 refers to the pushing rod.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

All of the angle $\theta$ described in the claims and the summary of the invention, and the angles $\theta_3$, $\theta_6$, $\theta_7$, and $\theta_9$ described in the embodiments refer to the angle formed between the driving mechanism and the lifting arm.

First Embodiment:

FIGS. 1-5 illustrate a height adjustment platform of a first embodiment. The height adjustment platform can include a first working table 1, a bottom bracket 2, two lifting arms 3, two driving mechanisms used to drive the lifting arms 3, and a control switch 5 configured to control the driving mechanism. Two ends of each lifting arm 3 can be rotatably coupled to the first working table 1 and the bottom bracket 2, respectively. When in use, the lifting arms 3 and the bottom bracket 2 can rotate an angle $\alpha$ ranging from about 0 to about 60 degrees. The driving mechanism can be mounted on one lifting arm 3, and there can be an angle $\theta_3$ formed between the driving mechanism and the corresponding lifting arm 3.

The lifting arm 3 can include a first rod 31, a second rod 32, a first joint device 33, and a second joint device 34. The first rod 31 can be parallel to the second rod 32. Two ends of the first rod 31 can be respectively coupled to the first joint device 33 and the second joint device 34. Two ends of the second rod 32 can be respectively coupled to the first joint device 33 and the second joint device 34. The first rod 31 can be coupled to the first joint device 33 via a first hinge point 331. The first rod 31 can be coupled to the second joint device 33 via a second hinge point 341. The second rod 32 can be coupled to the first joint device 33 via a third hinge point 332. The second rod 32 can be coupled to the second joint device 34 via a forth hinge point 342. The first rod 31, the second rod 32, the first joint device 33, and the second joint device 34 can be connected end to end, such that the first rod 31, the second rod 32, the first joint device 33, and the second joint device 34 cooperatively form a parallelogram structure.

A power device can be integrated with the locking device to form the driving mechanism. The driving mechanism can be a self-locking gas spring 4. The self-locking gas spring 4 can be positioned in the parallelogram structure of the lifting arm 3. There can be an angle $\theta_3$ formed between the self-locking gas spring 4 and the second rod 32 of the lifting arm 3. The self-locking gas spring 4 can include a base body 41, a releasing rod 42, and a releasing head 43 coupled to the base body 41 via the releasing rod 42. The control switch 5 can be positioned on the bottom of the first working table 1. The control switch 5 can include a control wire 51, a fasten member 52 mounted on the bottom of the first working table 1, and a handle 53 mounted on the fasten member 52. A first end of the control wire 51 can be coupled to the handle 53, and the second end of the control wire 51 can be coupled to the releasing head 43 of the self-locking gas spring 4. The height of the first working table 1 can be free to select from heights between the lowest point and the highest point according to adjust the self-locking gas spring 4, thus increasing the utility of the height adjustment platform.

Both of the first joint device 33 and the second joint device 34 can be a hinge. Two ends of the lifting arm 3 can be respectively coupled to the first working table 1 and the bottom bracket 2. A first end of the lifting arm 3 can be coupled to the first working table 1 via the first joint device 33, and the second end of the lifting arm 3 can be coupled to the bottom bracket 2 via the second joint device 34. The first joint device 33 can be vertically positioned to the first working table 1. The second joint device 34 can be vertically positioned to the bottom bracket 2. When in use, both of the lifting arms 3 and the bottom bracket 2 can rotate an angle $\alpha$ ranging from about 0 to about 60 degrees. The lifting arm 3 can rotate a small angle to lead the first working table 1 to be substantially vertically lifted according to the first joint device 33 and the second joint device 34. As thus, when the first working table 1 is lifted, the first working table 1 cannot horizontally move a long distance to increase an operation space.

The height adjustment platform can include a connecting rod 8 positioned between the two lifting arms 3. Two opposite ends of the connecting rod 8 can be respectively coupled to the two lifting arms 3. The connecting rod 8 can be configured to enhance the strength and the stability of structure.

The height adjustment platform can also include a second working table 9 and two support arms 10. Both of the second working table 9 and the two support arms 10 can be positioned below the first working table 1. The second working table 9 can be coupled to the bottom of the first working table 1 via the support arms 10. The second working table 9 can be used as a keyboard tray. An area of the second working table 9 can be more than a half of the area of the first working table 1.

The bottom bracket 2 can include two parallel poles 21. Preferably, at least one strengthening rib 22 can be positioned between the two parallel poles 21.

A height adjustment method can include: applying a first working table 1, a bottom bracket 2, at least one lifting arm 3, at least one driving mechanism configured to drive and lock the lifting arm 3, and at least one control switch 5 configured to control the driving mechanism. Wherein two ends of the lifting arm 3 can be respectively coupled to the first working table 1 and the bottom bracket 2, a self-locking gas spring can be used as the driving mechanism and coupled to the lifting arm 3, an angle $\theta_3$ can be formed between the self-locking gas spring 4 and a second rod 32 of the lifting arm 3.

The control switch 5 can control the driving mechanism to move the lifting arm 3 which is coupled to the driving mechanism with the angle $\theta_3$ formed between the driving mechanism and the lifting arm, so as to lift the first working table 1.

The height adjustment method includes two steps.

Firstly, the driving mechanism is controlled to start, and the first working is lifted or pressed, such that the driving mechanism can jack up the lifting arm 3 which is coupled to the driving mechanism with the angle $\theta_3$ formed between the driving mechanism and the lifting arm to lift the first working table 1, or the driving mechanism can shrink the lifting arm which is coupled to the driving mechanism with the angle $\theta_3$ formed between the driving mechanism and the lifting arm to move down the first working table 1.

Secondly, after the first working table 1 moves to a predetermined position which is located between the lowest point and the highest point of the first working table 1, the driving mechanism is controlled to be closed, so as to lock the lifting arm 3 and lock the first working table 1 to the predetermined position.

The height adjustment platform of the present invention is used according to the follow method.

Firstly, the user can hold the handle 53 and open the handle 53, and then the releasing head 43 of the self-locking gas spring 4 can be opened according to the control wire 51, and then the user can subsidiarily lift or press the first working table 1 lightly, the releasing rod 42 of the self-locking gas spring 4 can extend to jack up the lifting arm 3 to raise the first working table 1, or the releasing rod 42 of the self-locking gas spring 4 can shrink to move down the lifting arm 3 and the first working table 1.

Secondly, after the first working table 1 moves to the predetermined position between the lowest point and the highest point of the first working table 1, the user can release the handle 53 to reset the control switch 5, the releasing head 43 can rest according to controlling the self-locking gas spring 4 via the control wire 51, and then the first working table 1 can be locked on the predetermined position by the self-locking gas spring 4.

Figure 6:
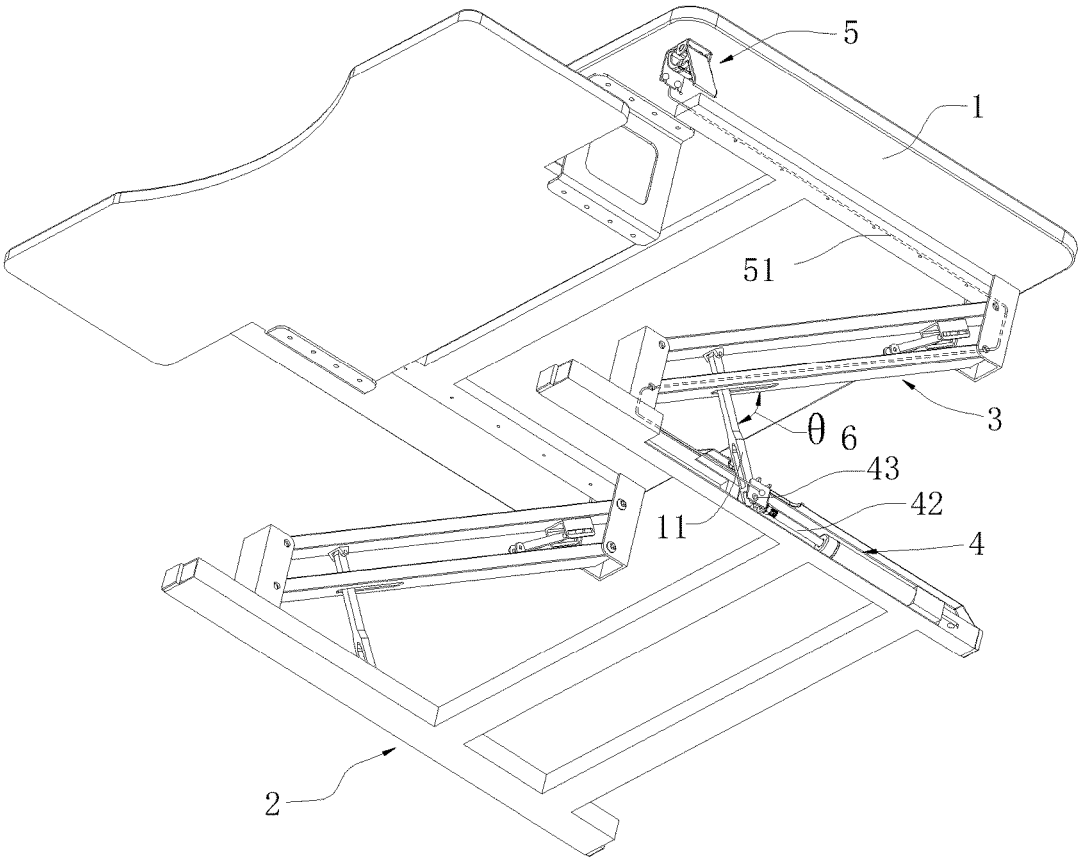
FIG. 6 is an isometric view of a second embodiment of a height adjustment platform.

Second Embodiment:

FIG. 6 illustrates a height adjustment platform of a second embodiment similar to the height adjustment platform of the first embodiment. The difference can be that the self-locking gas spring 4 used as the driving mechanism can be positioned on the bottom bracket 2, the driving mechanism can include a support rod 11. A first end of the support rod 11 can be coupled to the releasing head 43, and a second end of the support rod 11 can extend into the parallelogram structure to connect the rod of the lifting arm 3. An angle $\theta_6$ can be formed between the support rod 11 and the rod of the lifting arm 3.

When in use, the releasing rod 42 of the self-locking gas spring 4 can extend to jack up the lifting arm 3 and the working table via the support rod 11, or the releasing rod 42 of the self-locking gas spring 4 can shrink to move down the lifting arm 3 and the working table via the support rod 11.

The driving mechanism can be positioned on the bottom bracket 2 to prevent the first working table 1 from inclining, and to decrease the weight of the first working table 1.

Other aspects of this embodiment are like those of the first embodiment.

Figure 7:
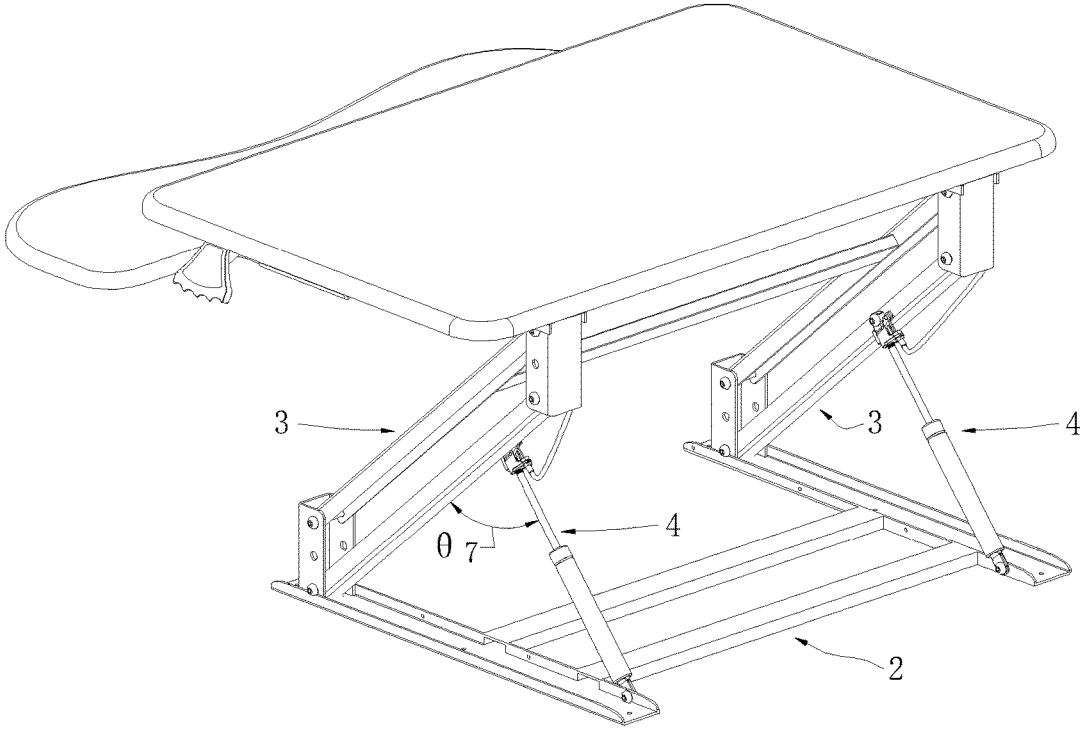
FIG. 7 is an isometric view of a third embodiment of a height adjustment platform.

Third Embodiment:

FIG. 7 illustrates a height adjustment platform of a third embodiment similar to the height adjustment platform of the first embodiment. The difference can be that the self-locking gas spring 4 used as the driving mechanism can be positioned outside of the parallelogram structure, for example, the self-locking gas spring 4 can be positioned on the bottom bracket 2. The self-locking gas spring 4 can be coupled to the rod of the lifting arm 3, and an angle $\theta_7$ can be formed between the rod of the lifting arm 3 and self-locking gas spring 4.

Other aspects of this embodiment are like those of the first embodiment.

Figure 8:
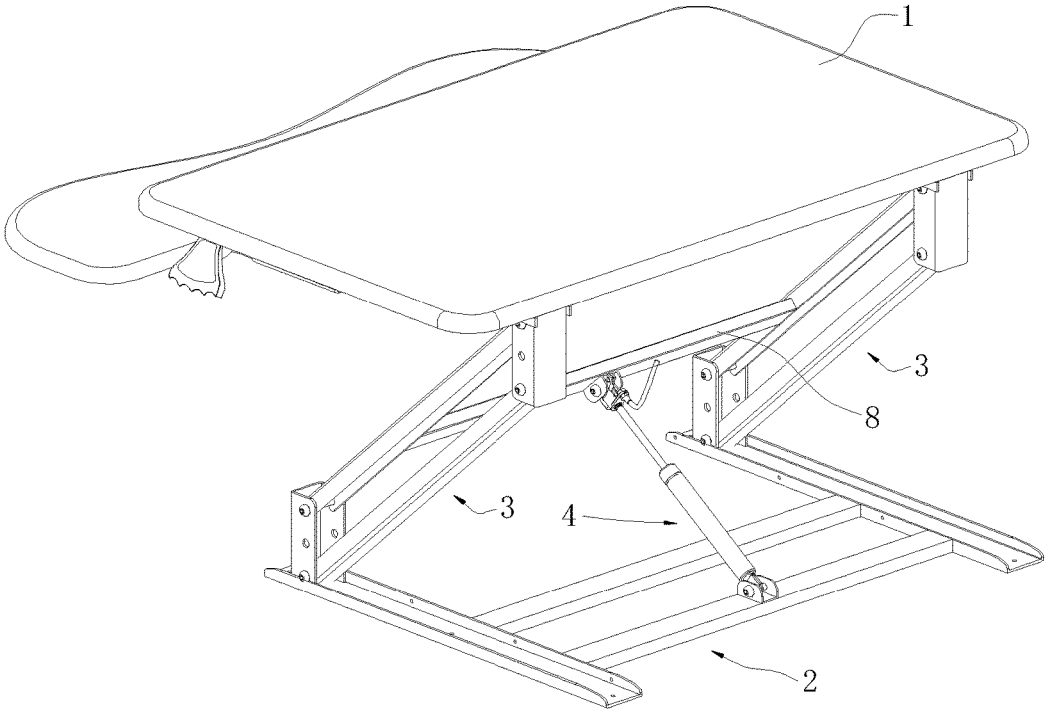
FIG. 8 is an isometric view of a forth embodiment of a height adjustment platform.

Fourth Embodiment:

FIG. 8 illustrates a height adjustment platform of a forth embodiment similar to the height adjustment platform of the first embodiment. The difference can be that the self-locking gas spring 4 used as the driving mechanism can be positioned on the bottom bracket 2. An end of the self-locking gas spring 4 can be coupled to the connecting rod 8, and can be configured to drive the connecting rod 8. The self-locking gas spring 4 can move the connecting rod 8. The lifting arm 3 can be rotatably coupled to the first working table 1 and the bottom bracket 2.

Other aspects of this embodiment are like those of the first embodiment.

Figure 9:
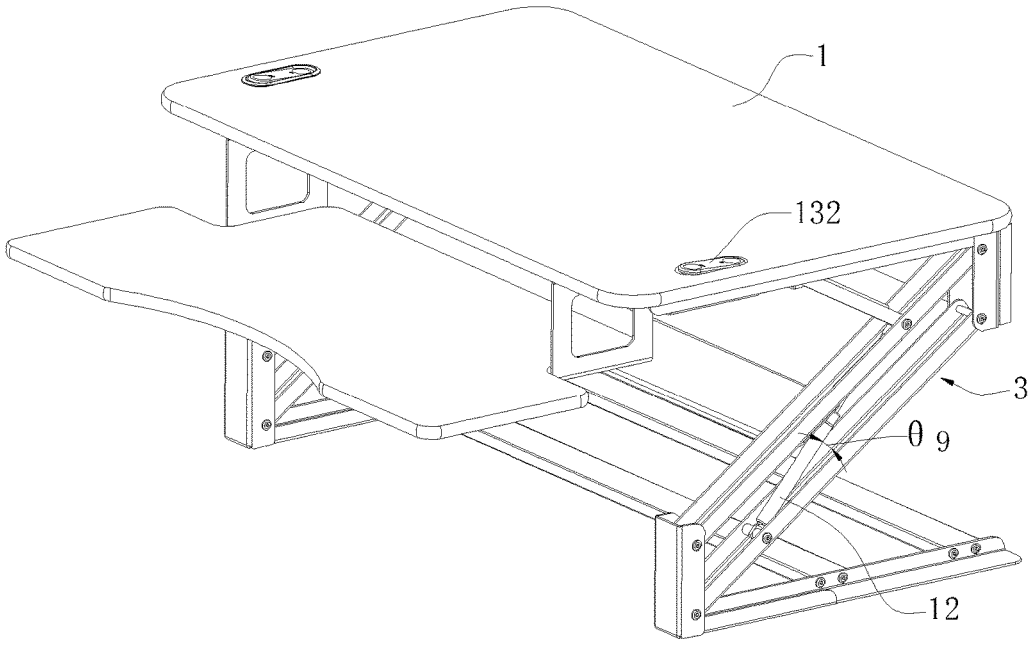
FIG. 9 and FIG. 10 cooperatively show an isometric view of a fifth embodiment of a height adjustment platform.
Figure 10:
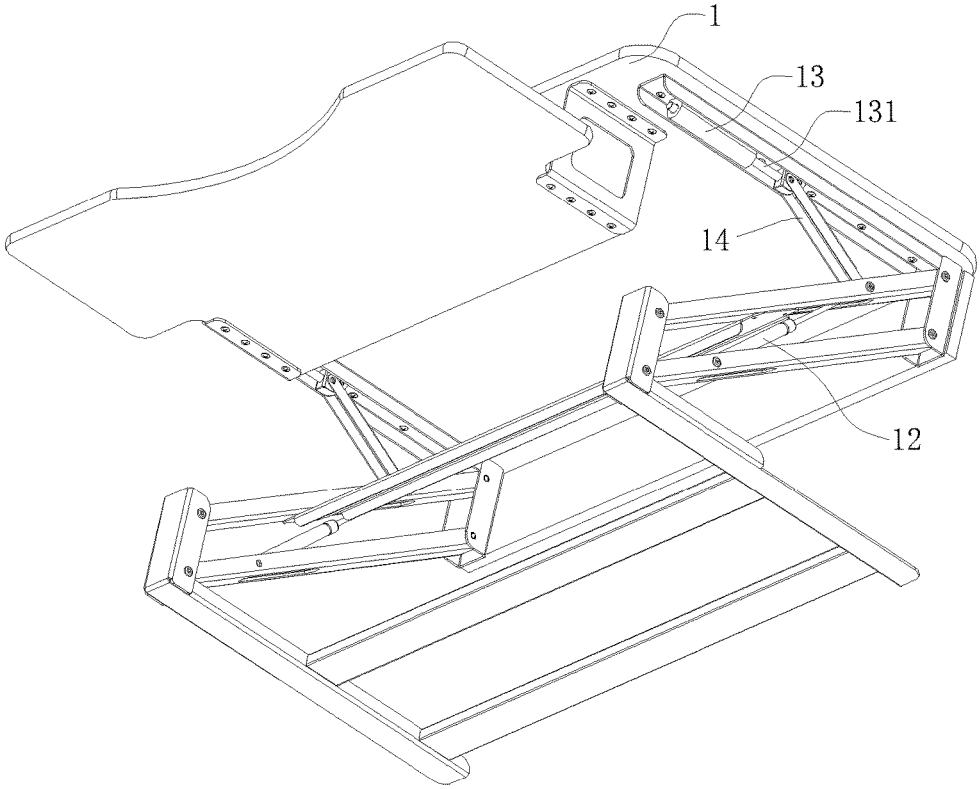

Fifth Embodiment:

FIGS. 9 and 10 illustrate a height adjustment platform of a fifth embodiment similar to the height adjustment platform of the first embodiment. The power device 12 and the locking device 13 can be positioned apart from each other, and an angle $\theta_9$ can be formed between the power device 12 and the lifting arm 3.

A gas spring can be used as the power device 12. A mechanical locking device can be used as the locking device 13. The locking device 13 can include a telescopic pole 131 and a button switch 132. The telescopic pole 131 can be coupled to the power device 12 via a pushing rod 14. The button switch 132 of the locking device 13 can be configured to control the telescopic pole 131 to extend or to shrink. When the button switch 132 is opened, the telescopic pole 131 can be located on an extending state, and the user can move up and down the first working table 1 to the predetermined position according to the drive of the power device 12. When the first working table 1 is moved to the predetermined position, the user can close the button switch 132 to lock the first working table 1 on the predetermined position, and the telescopic pole 131 can be located on a locking state.

Other aspects of this embodiment are like those of the first embodiment.

Figure 11:
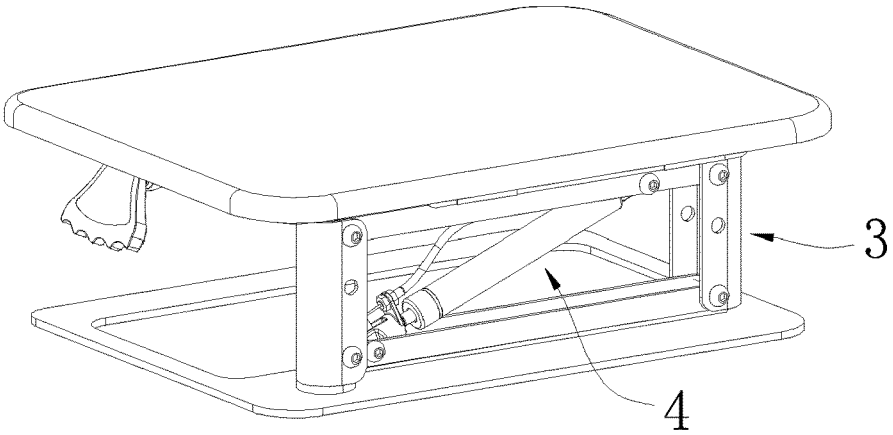
FIG. 11 is an isometric view of a sixth embodiment of a height adjustment platform.

Sixth Embodiment:

FIG. 11 illustrates a height adjustment platform of a sixth embodiment similar to the height adjustment platform of the first embodiment. The difference can be that the height adjustment platform can include one lifting arm 3, and one driving mechanism configured to drive and lock the lifting arm 3. The driving mechanism can be the self-locking gas spring 4. The height adjustment platform cannot include the connecting rod.

Other aspects of this embodiment are like those of the first embodiment.

Figure 12:
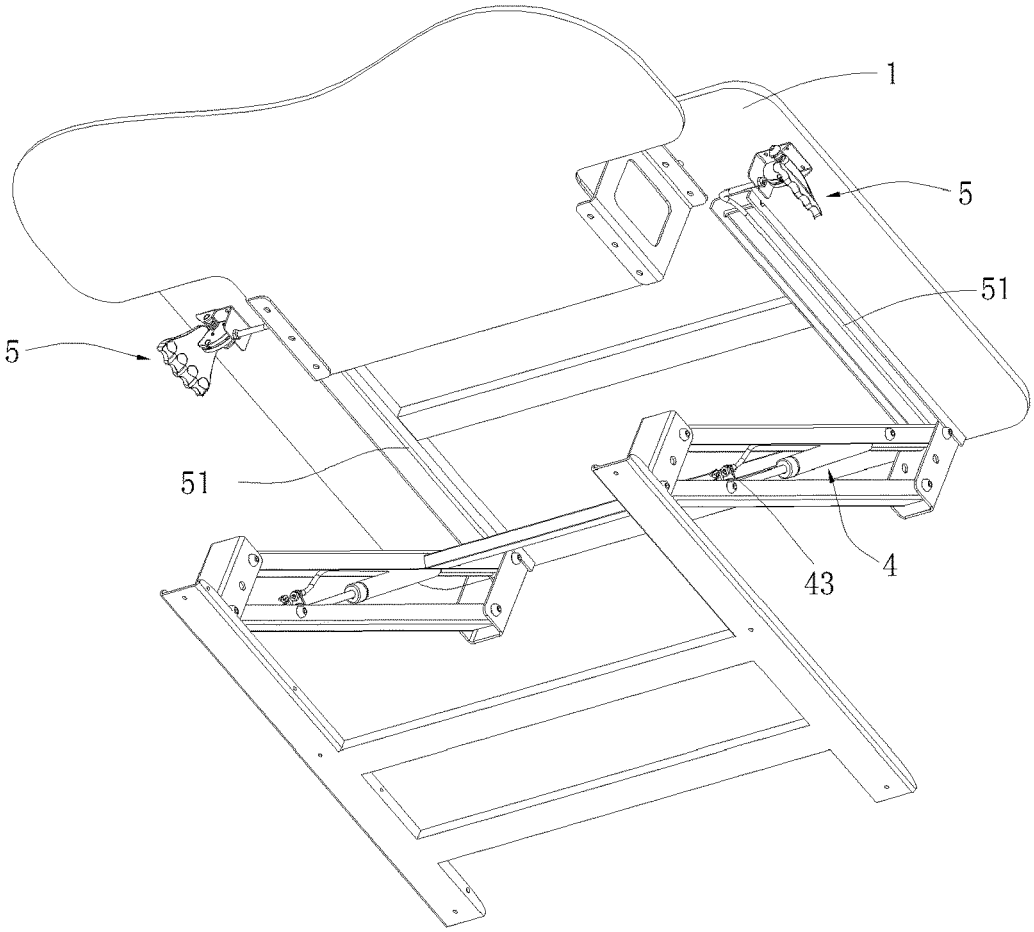
FIG. 12 is an isometric view of a seventh embodiment of a height adjustment platform.

Seventh Embodiment:

FIG. 12 illustrates a height adjustment platform of a seventh embodiment similar to the height adjustment platform of the first embodiment. The difference can be that the height adjustment platform can include two control switches 5 positioned on opposite sides of the bottom of the first working table 1. The two control switches 5 can be respectively coupled to the releasing head 43 of the self-locking gas spring 4 via the control wire 51. The two control switches 5 can be respectively operated by left hand and right hand of the user to improve the operation convenience.

Other aspects of this embodiment are like those of the first embodiment.

The embodiments shown and described above are only examples. Many details are often found in the art, such as features of control system and control method for vehicle anti-theft. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. Therefore, those of ordinary skill in the art can make various modifications to the embodiments without departing from the scope of the disclosure, as defined by the appended claims.

What is claimed is:

1. A height adjustment platform, comprising:

a first working table;

a bottom bracket;

at least one lifting arm comprising:

a first elongate portion and a second elongate portion, wherein the first and second elongate portions have a same shape and are displaced parallel to each other;

a first joint device and a second joint device, wherein the first and second joint devices have a same shape and are displaced parallel to each other and are perpendicular to the first working table, wherein opposite ends of each of the first elongate portion and the second elongate portion are coupled to the first joint device and the second joint device, respectively;

wherein the first and second elongate portions and the first and second joint devices are configured to move in a same plane during motion of the table height adjustment;

at least one driving mechanism configured to drive and lock the lifting arm, wherein a first end of the driving mechanism is connected to the first elongate portion of the lifting arm and a second end of the driving mechanism is connected to the second elongate portion of the lifting arm; and at least one control switch configured to control the driving mechanism;

wherein an angle $\theta$ is formed between the driving mechanism and the lifting arm;

wherein the first joint device is coupled to the first working table at a fixed location along the first working table;

wherein the second joint device is coupled to the bottom bracket at a fixed location along the bottom bracket; and wherein each of the ends of the first and second elongate portions attached to the first joint device are in vertical alignment and each of the ends of the first and second elongate portions attached to the second joint device are in vertical alignment such that an angle $\alpha$ ranging from 0 to 60 degrees is formed between the lifting arm and the bottom bracket.

2. The height adjustment mechanism of claim 1, wherein the first elongate portion and the second elongate portion are two parallel rods; the two rods, the first joint device, and the second joint device are coupled end to end to cooperatively form a parallelogram structure.

3. The height adjustment mechanism of claim 2, wherein the driving mechanism is positioned in the parallelogram structure, and the angle $\theta$ is formed between the driving mechanism and the parallel rods of the lifting arm.

4. The height adjustment mechanism of claim 1, wherein a power device is integrated with a locking device to form the driving mechanism, or the driving mechanism comprises the power device and the locking device positioned apart from the power device.

5. The height adjustment mechanism of claim 1, wherein the driving mechanism is a self-locking gas spring, the self-locking gas spring comprises a base body, a releasing rod, and a releasing head coupled to the base body via the releasing rod.

6. The height adjustment mechanism of claim 5, wherein the control switch comprises a control wire, a fasten member, and a handle mounted on the fasten member; a first end of the control wire is coupled to the handle, a second end of the control wire is coupled to the releasing head of the self-locking gas spring.

7. The height adjustment platform of claim 1, wherein the lifting arm is rotatably coupled to the first working table and the bottom bracket via the first joint device and the second joint device, respectively; when in use, the lifting arm and the bottom bracket rotate relative to one another to form the angle $\alpha$ ranging from 0 to 60 degrees.

8. The height adjustment platform of claim 1, comprising two lifting arms and at least one connecting rod, wherein the two lifting arms are positioned on opposite sides between the first working table and the bottom bracket, the connecting rod is positioned between the two lifting arms, and two opposite ends of the connecting rod are coupled to the two lifting arms.

9. The height adjustment platform of claim 1, further comprising a second working table positioned below the first working table, wherein the second working table is coupled to the bottom of the first working table via at least one support arm.

10. The height adjustment platform of claim 9, wherein an area of the second working table is more than a half of the area of the first working table.

11. A height adjustment method comprising:

applying a first working table, a bottom bracket, at least one lifting arm comprising a first elongate portion and a second elongate portion, at least one driving mechanism configured to drive and lock the lifting arm, and at least one control switch configured to control the driving mechanism, wherein a first end of the driving mechanism is connected to the first elongate portion of the lifting arm and a second end of the driving mechanism is connected to the second elongate portion of the lifting arm, wherein the first and second elongate portions have a same shape and are displaced parallel to each other;

wherein two ends of the lifting arm are respectively coupled to the first working table and the bottom bracket at a fixed location along the first working table and the bottom bracket, respectively;

wherein an angle $\theta$ is formed between the driving mechanism and the lifting arm;

wherein two ends of the first and second elongate portions are attached to a first joint device in vertical alignment and two ends of the first and second elongate portions are attached to a second joint device in vertical alignment such that an angle $\alpha$ ranging from 0 to 60 degrees is formed between the lifting arm and the bottom bracket;

wherein the first and second joint devices have a same shape and are displaced parallel to each other and are perpendicular to the first working table; and wherein the first and second elongate portions and the first and second joint devices are configured to move in a same plane during motion of the table height adjustment.

12. The height adjustment method of claim 11, further comprising:

controlling the driving mechanism to start, and lifting or pressing the first working table, such that the driving mechanism can jack up or move down the first working table; and controlling the driving mechanism to close after the first working table moves to a predetermined position which is located between the lowest point and the highest point of the first working table, and locking the first working table to the predetermined position.

13. The height adjustment method of claim 11, wherein the first joint device is coupled to the first working table; and the second joint device is coupled to the bottom bracket.

* * * * *